United States Patent [19]

Rock et al.

[11] 4,090,753

[45] May 23, 1978

[54] FASTENING DEVICE

[75] Inventors: Erich Rock, Hochst; Bernhard Mages, Dornbirn, both of Austria

[73] Assignee: Julius Blum Gesellschaft m.b.H., Hochst, Austria

[21] Appl. No.: 701,752

[22] Filed: Jun. 30, 1976

[30] Foreign Application Priority Data

Jul. 3, 1975 Austria ..... 5152/75

[51] Int. Cl.[2] ..... F16B 12/00

[52] U.S. Cl. ..... 312/140; 312/330 R; 248/243

[58] Field of Search ..... 312/140, 330, 263; 248/241, 242, 243

[56] References Cited

U.S. PATENT DOCUMENTS

| | | | |
|---|---|---|---|
| 1,055,522 | 3/1913 | Cumming | 248/243 |
| 1,136,071 | 4/1915 | Weiss | 312/330 |
| 1,254,094 | 1/1918 | Vogt | 248/243 |
| 1,571,601 | 2/1926 | Richards | 312/263 |
| 2,701,174 | 2/1955 | Franks | 312/263 |
| 2,963,170 | 12/1960 | Lori | 248/242 |
| 3,278,208 | 10/1966 | Smith | 312/140 |
| 3,509,665 | 5/1970 | Bartlett et al. | 312/330 |
| 3,561,713 | 2/1971 | Berkowitz | 248/242 |

FOREIGN PATENT DOCUMENTS

| | | | |
|---|---|---|---|
| 1,291,602 | 3/1962 | France | 312/263 |
| 1,192,743 | 10/1959 | France | 312/263 |
| 1,327,884 | 4/1963 | France | 248/242 |
| 1,024,757 | 4/1953 | France | 312/140 |

*Primary Examiner*—Paul R. Gilliam
*Assistant Examiner*—Victor N. Sakran
*Attorney, Agent, or Firm*—Haseltine, Lake & Waters

[57] ABSTRACT

A fastening device for an adjustable front panel of pull-out furniture parts, particularly for drawers having guide rails, wherein each guide rail has a supporting part with a fastening leaf for cooperation with a retaining part secured to the front panel, and the retaining part being angularly adjustably located on the supporting part at least with respect to height, and being fixable in position by means of fastening screws, comprising an eccentric located in the fastening leaf, which cooperates with a stop in the retaining part.

7 Claims, 6 Drawing Figures

FASTENING DEVICE

The present invention relates to a fastening device for adjustable front panels of pull-out furniture parts, especially for drawers, having guide rails, where each guide rail has a preferably angular supporting part with a fastening leaf for a retaining part securable to the front panel, and the retaining part is located on the supporting parts so as to be adjustable at least with respect to height and is fixable by means of fastening screws.

The object of such fastening devices, which are being used more and more especially in modern kitchen design, is to provide fastening for the front panels of drawers or also for the front plates of pull-out boards, which allows the moving and final adjustment of the front panel in at least three-dimensions, so that even with bigger tolerances that are incurred, for example during assembly of the guide rails of the drawer, the front panel can be evenly and vertically aligned.

Such fastening devices provide for simple adjustability, at the same time, however, it should be taken into consideration that by means of the lever effect of the front panel it is possible that considerable forces act on the connecting point of the fastening device with the guide rail of the drawer.

In fastening devices known hitherto, the various adjusting parts are located at the sides of the drawers.

This causes certain problems in respect of the side walls of the drawers and furthermore the various recesses, holes and screws are visible when the drawer is pulled out which results in an unsightly impression, especially as they readily become soiled. A further known fastening device (Austrian Pat. No. 312,195) illustrates a special design of the holes of a joining flange for easier assembly of the front panel. Another fastening device for front angles (Austrian Pat. No. 304,803) discloses a fitting which engages behind a vertical shank of the front angle.

It has proved to be disadvantageous in these last-mentioned two fastening devices that the vertical adjustment of the front panel effected by means of a conventional setscrew which is screwed from above into the fitting, as the screws can turn of their own accord after some time, accurate adjustment is tedious and dirt can settle on the screw.

It is therefore an object of the present invention to provide a fastening device for the front panels of drawers which overcomes the above-mentioned disadvantages. The fastening device according to the invention provides for an easy and rapid anchoring of the retaining part in the supporting part, while the subsequent adjustment can be effected in all directions without impediment and independently of the adjustment and fixing with reference to any other direction.

This is achieved according to the invention by means of an eccentric located in the fastening leaf which which a stop cooperates in the retaining part.

A further advantage of the present invention is that the fastening leaf has a bent portion, the jutting or protrusion of the bent portion corresponding approximately to the thickness of the eccentric.

The invention allows easy and rapid adjustment of the device is not externally visible, and therefore cannot become unsightly soiled.

Two embodiments of the present invention will be described hereinafter with reference to the Figures of the attached drawings without being limited thereto.

Also, the reference numerals used in the appended claims are not intended to impart any restrictions thereon but are only included to facilitate identifying the parts referred to in the drawings and the description. In the drawings;

FIG. 1 ia a perspective diagrammatic view of a fastening device according to the invention;

Figure 1:
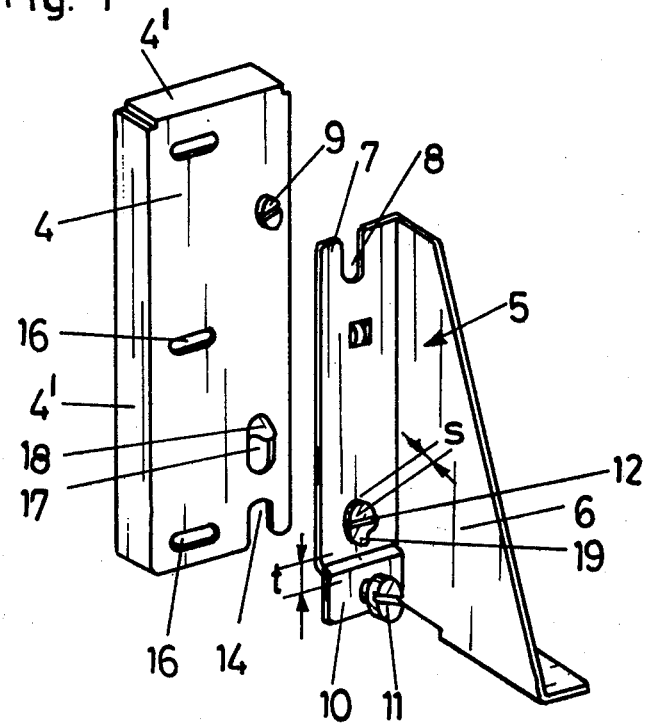

In the drawings, furniture body, side walls of the drawers and guide rails on the side walls of the drawers are not shown, as they do not directly belong to the invention and are familiar to every person skilled in the art.

As it is apparent from the figures of the drawings, the drawer which in the present case is a board 1, is furnished with a guide rail 2 having a Z-shaped profile, which carries a fastening device 3 at its front end.

By means of the fastening device 3, front panel 14 in turn is secured to the bottom board 1.

Fastening device 3 essentially comprises a retaining part 4 and a supporting part 5. Supporting part 5 is directly secured to the front end of the guide rail 2 by means of a sideways support 6 which is aligned in the longitudinal direction of guide rail 2.

The supporting part 5 has on the front thereof a bent fastening leaf 7 which is parallel to a front panel 14 and perpendicular to the pull-out direction. As can be seen particularly in FIG. 1, fastening leaf 7 is provided in this embodiment with an upper slot 8, which - (FIG. 3) is adapted to accomodate an adjusting screw 9 for - adjusting the angle.

In the lower part of the fastening leaf 7 there is a bent portion 10 which carries a fastening screw 11. In the embodiment the jutting or protrusion "t" of the bent portion 10 corresponds to the thickness "S" of an eccentric 12 located in the fastening leaf 7.

Figure 3:
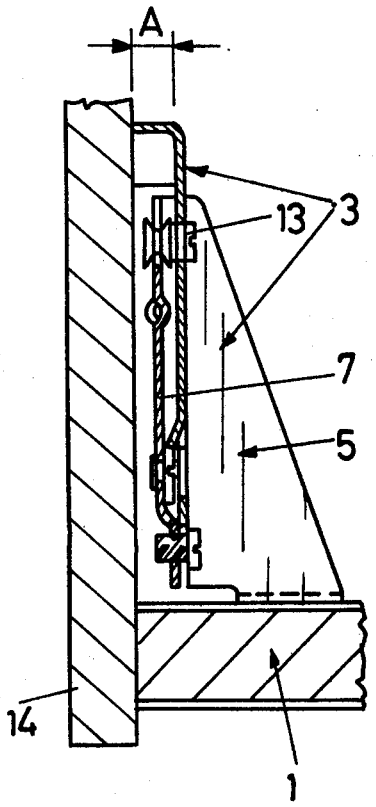
FIG. 3 is a side elevation of the fastening device according to the invention.

Retaining part 4 is provided over two complete sides and in the upper part of a third side with flanges 4', so that the fastening plate proper is in the assembled state, spaced a distance "A" in front of front panel 14. In the assembled state retaining part 4, as seen particularly in FIG. 3, is raised above fastening leaf 7 of supporting part 5, and the eccentric screw 9 located in retaining part 4 is inserted with its guide 13 into recess 8 in the fastening leaf 7. Similarly, fastening screw 11 extends into a slot 15 in retaining part 4.

Retaining part 4 is secured to the front panel 14 in a conventional way by way of screws not shown in the drawings which engage in oblong holes or slots 16 of retaining plate 4.

In this embodiment, therefore, after the retaining part 4 has been screwed onto the front panel 14, the front panel is anchored to supporting part 5 simply by interengaging retaining part 4 and fastening leaf 7.

In the embodiment shown in FIG. 1, the sideways adjustment of the front panel 14 can be effected by loosening the screws extending into slots 16, then adjusting front panel 14 and re-tightening the screws.

Angular adjustment is carried out by turning adjustment screw 13, whereby retaining part 4 moves on the thread of adjustment screw 13.

For adjustment with respect to height the eccentric 12 is provided, which projects into a hole 17 in retaining part 4. The top edge of hole 17 forms a stop 18 which coacts with a cam 19 of the eccentric 12.

After height adjustment has been completed, retaining part 4 can be fixed by tightening fastening screw 11.

Figure 4:
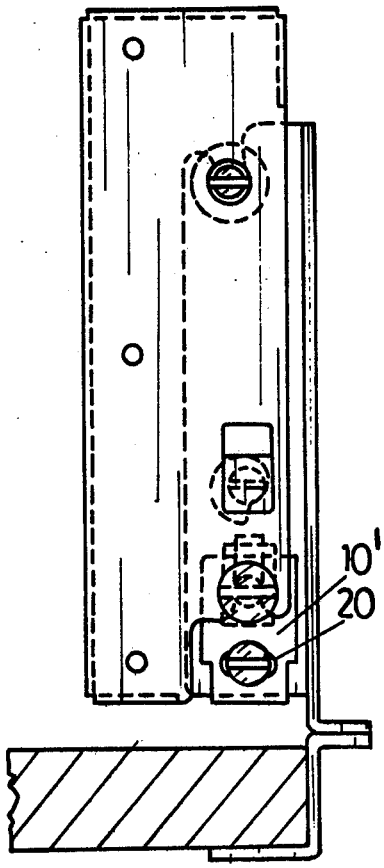
FIG. 4 is a front elevation of a further embodiment of a fastening device according to the invention.
Figure 5:
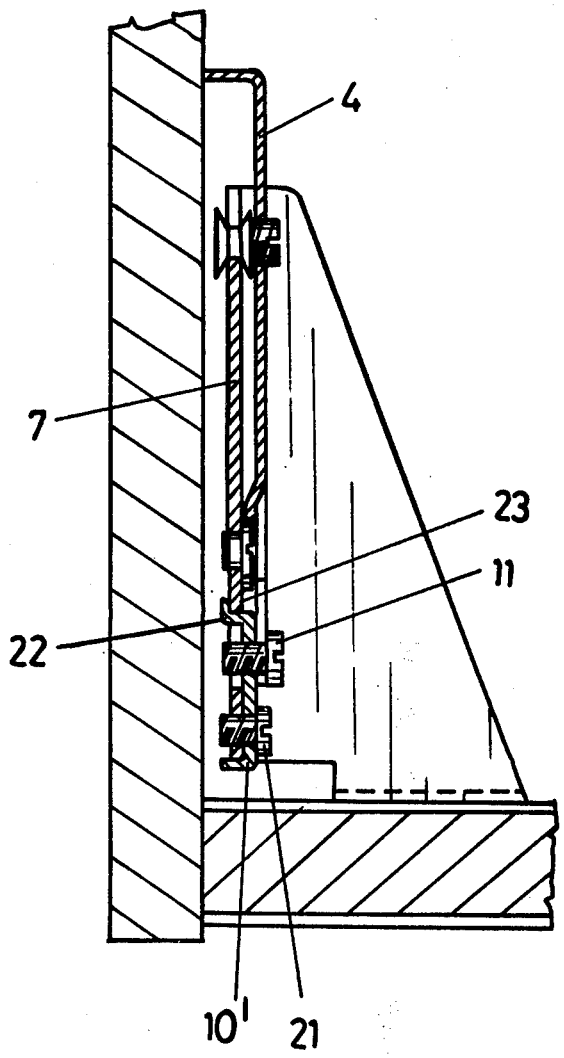
FIG. 5 is a side elevation, partially sectioned, of the fastening device according to FIG. 4.
Figure 6:
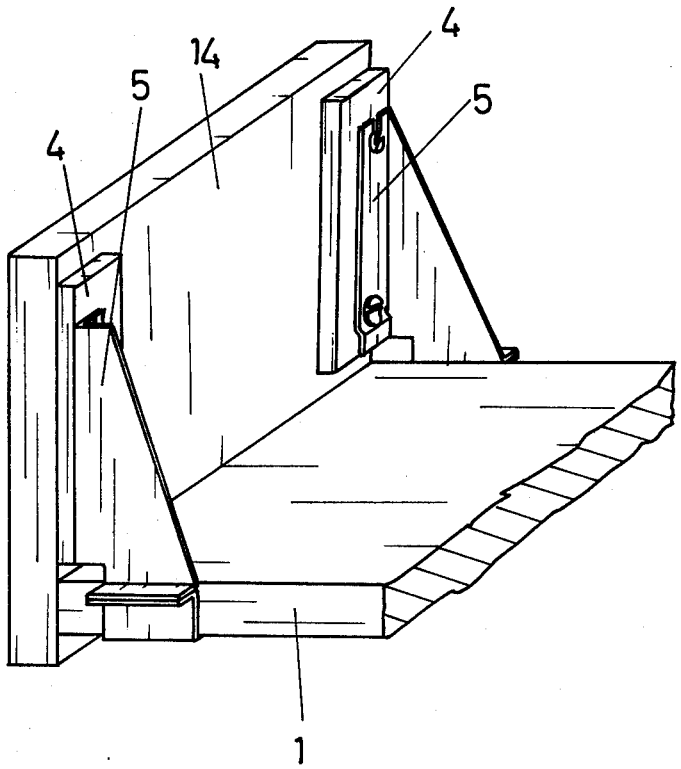
FIG. 6 is a schematic perspective view of a drawer with the fastening device according to the invention.

In the embodiment according to FIGS. 4 and 5, the bent portion is designed as an independent intermediate piece 10'. The intermediate piece 10' has a lug 22 which extends into a corresponding slot 23 of fastening leaf 7.

In the lower part thereof the intermediate piece 10' has a longitudinal slot 20 through which extends a fixing screw 21 which is positioned in fastening leaf 7.

Figure 2:
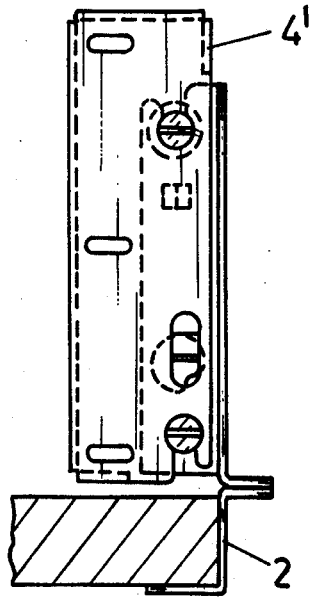
FIG. 2 is a front elevation of the fastening device according to the invention.

Intermediate piece 10' in turn carries the fastening screw 11 into which retaining part 4 is inserted during assembly. By means of this design the sideways adjustment of the front panel can be effected directly by the fitting itself. The oblong slots 16 on retaining part 4 therefore are unnecessary and the fixing of the front panel in the lateral direction is carried out by tightening screw 21. Vertical and angular adjustment as well as the fixation of retaining part 4 and hence of the front panel is carried out analogous to embodiment according to FIGS. 1–3.

We claim:

1. A fastening device (3) for an adjustable front panel (14) of pull-out furniture parts, particularly for drawers (1) having guide rails (2), comprising for each guide rail a supporting part (5) with a fastening leaf (7) for cooperation with a retaining part (4) secured to the front panel, said retaining part being adjustably located on said supporting part at least with respect to height, and being fixable in position by means of fastening screws (11), and an eccentric (12) located in said fastening leaf, which cooperates with a stop (18) in said retaining part for positioning the respective parts.

2. The fastening device as defined in claim 1, wherein said fastening leaf (7) has a bent portion (10, 10'), the protrusion *(t)* of which corresponds to the thickness (s) of said eccentric (12).

3. The fastening device as defined in claim 2, wherein said bent portion is a separate intermediate piece (10') mounted on said fastening leaf (7) for sideways movement.

4. The fastening device as defined in claim 1, further comprising an element for angular adjustment, in the form of an adjusting screw (9) having an annular guide (13), the latter being insertable into a slot (8) in said fastening leaf (7).

5. The fastening device as defined in claim 1, wherein said supporting part (5) is angular.

6. The fastening device as defined in claim 1, wherein said retaining part (4) is angularly adjustable by said eccentric (12).

7. A fastening device (3) for an adjustable front panel (14) of pull-out furniture parts, particularly for drawers (1) having guide rails (2), comprising for each guide rail a supporting part (5) with a fastening leaf (7) for cooperation with a retaining part (4) secured to the front panel, said retaining part being adjustably located on said supporting part at least with respect to height, and being fixable in position by means of fastening screws (11), and an eccentric (12) located in said fastening leaf, which cooperates with a stop (18) in said retaining part, said fastening leaf having a bent portion, the protrusion of which corresponds to the thickness of said eccentric, said bent portion being a separate intermediate piece mounted on said fastening leaf for sideways movement, and element for angular adjustment in the form of an adjusting screw having an annular guide, said guide being insertable into a slot in said fastening leaf, said supporting part being angular, said retaining part being angularly adjustable by said eccentric.

* * * * *